US011661720B2

(12) United States Patent
Waters

(10) Patent No.: US 11,661,720 B2
(45) **Date of Patent: *May 30, 2023**

(54) ATTACHMENT SYSTEM FOR A WORK VEHICLE IMPLEMENT

(71) Applicant: CNH Industrial America LLC, New Holland, PA (US)

(72) Inventor: Eric Michael Waters, Wichita, KS (US)

(73) Assignee: CNH Industrial America LLC, New Holland, PA (US)

( * ) Notice: Subject to any disclaimer, the term of this patent is extended or adjusted under 35 U.S.C. 154(b) by 711 days.

This patent is subject to a terminal disclaimer.

(21) Appl. No.: 16/711,943

(22) Filed: Dec. 12, 2019

(65) Prior Publication Data

US 2020/0115881 A1 Apr. 16, 2020

Related U.S. Application Data

(62) Division of application No. 15/437,161, filed on Feb. 20, 2017, now Pat. No. 10,508,408.

(51) Int. Cl.

| | |
|---|---|
| ***E02F 3/36*** | (2006.01) |
| ***E02F 3/76*** | (2006.01) |
| ***E02F 3/627*** | (2006.01) |
| *E02F 3/34* | (2006.01) |

(52) U.S. Cl.

CPC ..... *E02F 3/3618* (2013.01); *E02F 3/627* (2013.01); *E02F 3/7622* (2013.01); *E02F 3/3414* (2013.01)

(58) Field of Classification Search

CPC ..... E02F 3/3618; E02F 3/627; E02F 3/7622; E02F 3/3414

See application file for complete search history.

(56) References Cited

U.S. PATENT DOCUMENTS

| | | | | |
|---|---|---|---|---|
| 2,700,233 | A * | 1/1955 | Johnson | E02F 3/96 172/795 |
| 2,867,921 | A | 1/1959 | Brown | |
| 2,979,839 | A | 4/1961 | Hugger | |
| 3,054,520 | A | 9/1962 | Maloney | |

(Continued)

FOREIGN PATENT DOCUMENTS

| | | |
|---|---|---|
| EP | 1710145 | 10/2006 |

*Primary Examiner* — Jamie L McGowan

(74) *Attorney, Agent, or Firm* — Peter Zacharias

(57) ABSTRACT

An attachment system for a work vehicle implement includes an implement attachment assembly. The implement attachment assembly includes a support structure coupled to a receiver assembly. The support structure includes a first mounting feature configured to engage a first corresponding mounting feature extending downwardly from a bottom surface of a work vehicle, and a second mounting feature configured to engage a second corresponding mounting feature extending downwardly from the bottom surface of the work vehicle. The first and second mounting features of the support structure are spaced apart from one another along a longitudinal axis relative to a direction of travel of the work vehicle, and the first and second mounting features of the support structure are configured to substantially block horizontal and vertical movement of the support structure relative to the work vehicle via engagement with the first and second corresponding mounting features of the work vehicle.

18 Claims, 4 Drawing Sheets

(56) References Cited

U.S. PATENT DOCUMENTS

| | | | | |
|---|---|---|---|---|
| 3,071,793 | A | 1/1963 | Lull | |
| 3,150,884 | A | 9/1964 | Drott | |
| 3,473,242 | A | 10/1969 | Martin | |
| 3,688,847 | A | 9/1972 | Deeter | |
| 3,815,687 | A | 6/1974 | Federspiel | |
| 3,982,643 | A | 9/1976 | MacGregor et al. | |
| 4,153,117 | A | 5/1979 | Freese | |
| 4,185,698 | A | 1/1980 | Frisbee | |
| 4,220,210 | A | 9/1980 | Degelman | |
| 4,222,442 | A | 9/1980 | Westendorf et al. | |
| 4,279,084 | A * | 7/1981 | Low | E01H 5/06 37/236 |
| 4,307,523 | A | 12/1981 | Reissinger et al. | |
| 4,470,211 | A | 9/1984 | Rossmann | |
| 4,554,978 | A | 11/1985 | Schneider | |
| 4,615,130 | A | 10/1986 | Raciot | |
| 4,795,305 | A | 1/1989 | Friend | |
| 4,817,728 | A | 4/1989 | Schmid et al. | |
| 4,897,013 | A | 1/1990 | Thompson et al. | |
| 5,010,960 | A | 4/1991 | Barnes et al. | |
| 5,075,988 | A * | 12/1991 | Ciula | E01H 5/066 37/234 |
| 5,098,252 | A * | 3/1992 | Sheesley | E02F 3/3686 403/324 |
| 5,520,500 | A | 5/1996 | McIlwain et al. | |
| 5,975,216 | A | 11/1999 | Gibbons | |
| 6,102,131 | A | 8/2000 | Malinowski | |
| 6,371,314 | B1 | 4/2002 | Boisvert | |
| 6,484,421 | B1 * | 11/2002 | Donoghue | E01H 5/06 37/234 |
| 6,502,334 | B1 * | 1/2003 | Davies | E01H 5/06 37/231 |
| 7,108,475 | B1 | 9/2006 | Gustafson | |
| 7,302,765 | B1 | 12/2007 | Jorgenson et al. | |
| 9,057,179 | B1 | 6/2015 | Kubas | |
| 9,809,945 | B1 | 11/2017 | Middleton | |
| 10,508,408 | B2 * | 12/2019 | Waters | E02F 3/3618 |
| 2004/0045726 | A1 * | 3/2004 | Hollinrake | E02F 3/7613 172/830 |
| 2006/0018746 | A1 | 1/2006 | Gustafson et al. | |
| 2006/0053761 | A1 | 3/2006 | Lougheed et al. | |
| 2006/0124328 | A1 | 6/2006 | Schager | |
| 2006/0283053 | A1 | 12/2006 | Hickenbottom | |
| 2007/0025834 | A1 | 2/2007 | Gustafson | |
| 2007/0240928 | A1 | 10/2007 | Coltson et al. | |
| 2009/0136293 | A1 * | 5/2009 | Normann | E02F 3/3627 403/345 |
| 2010/0307778 | A1 | 12/2010 | Friesen et al. | |
| 2014/0317967 | A1 | 10/2014 | Parker et al. | |
| 2018/0238016 | A1 | 8/2018 | Seacat et al. | |

* cited by examiner

ATTACHMENT SYSTEM FOR A WORK VEHICLE IMPLEMENT

CROSS-REFERENCE TO RELATED APPLICATION

The present application is a divisional of U.S. patent application Ser. No. 15/437,161, entitled "ATTACHMENT SYSTEM FOR A WORK VEHICLE IMPLEMENT", filed Feb. 20, 2017, which is hereby incorporated by reference in its entirety.

BACKGROUND

The present disclosure relates generally to an attachment system for a work vehicle implement.

Certain work vehicles (e.g., tractors, skid steers, etc.) include a cab configured to house an operator, and a chassis configured to support the cab. The chassis is also configured to support wheels and/or tracks to facilitate movement of the work vehicle relative to a ground surface. In addition, various mechanical components of the work vehicle, such as a motor, a transmission, and a hydraulic system, among other components, may be supported by the chassis and/or disposed within an interior of the chassis. Certain work vehicles (e.g., skid steers) have an arm rotatably coupled to the chassis and configured to support an implement (e.g., dozer blade, grapple, etc.). For example, the arm may support a dozer blade to facilitate earth-moving operations. Accordingly, the horizontal forces experienced by the dozer blade are transmitted to the chassis of the work vehicle through the arm. Unfortunately, the maximum force rating of the dozer blade may be limited due to this arrangement (e.g., due to the maximum horizontal force rating of the arm).

BRIEF DESCRIPTION

In one embodiment, an attachment system for a work vehicle implement includes an implement attachment assembly. The implement attachment assembly includes a receiver assembly configured to couple to a connector assembly of an arm of a work vehicle. The implement attachment assembly also includes a support structure coupled to the receiver assembly. The support structure includes a first mounting feature configured to engage a first corresponding mounting feature extending downwardly from a bottom surface of the work vehicle, and a second mounting feature configured to engage a second corresponding mounting feature extending downwardly from the bottom surface of the work vehicle. In addition, the first and second mounting features of the support structure are spaced apart from one another along a longitudinal axis relative to a direction of travel of the work vehicle, and the first and second mounting features of the support structure are configured to substantially block horizontal and vertical movement of the support structure relative to the work vehicle via engagement with the first and second corresponding mounting features of the work vehicle.

In another embodiment, an attachment system for a work vehicle implement includes a work vehicle attachment assembly. The work vehicle attachment assembly includes a connector assembly pivotally coupled to an arm of a work vehicle. The connector assembly is configured to couple to a receiver assembly of an implement attachment assembly. The work vehicle attachment assembly also includes at least one mounting feature configured to extend downwardly from a bottom surface of the work vehicle. The at least one mounting feature is configured to move along a vertical axis of the work vehicle to selectively engage at least one corresponding mounting feature of a support structure of the implement attachment assembly to substantially block horizontal and vertical movement of the support structure relative to the work vehicle.

In a further embodiment, an attachment system for a work vehicle implement includes an implement attachment assembly. The implement attachment assembly includes a receiver assembly configured to couple to a connector assembly of an arm of a work vehicle. The implement attachment assembly also includes a linkage coupled to the receiver assembly. The linkage is configured to move the work vehicle implement along a vertical axis in response to rotation of the receiver assembly relative to the arm of the work vehicle.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
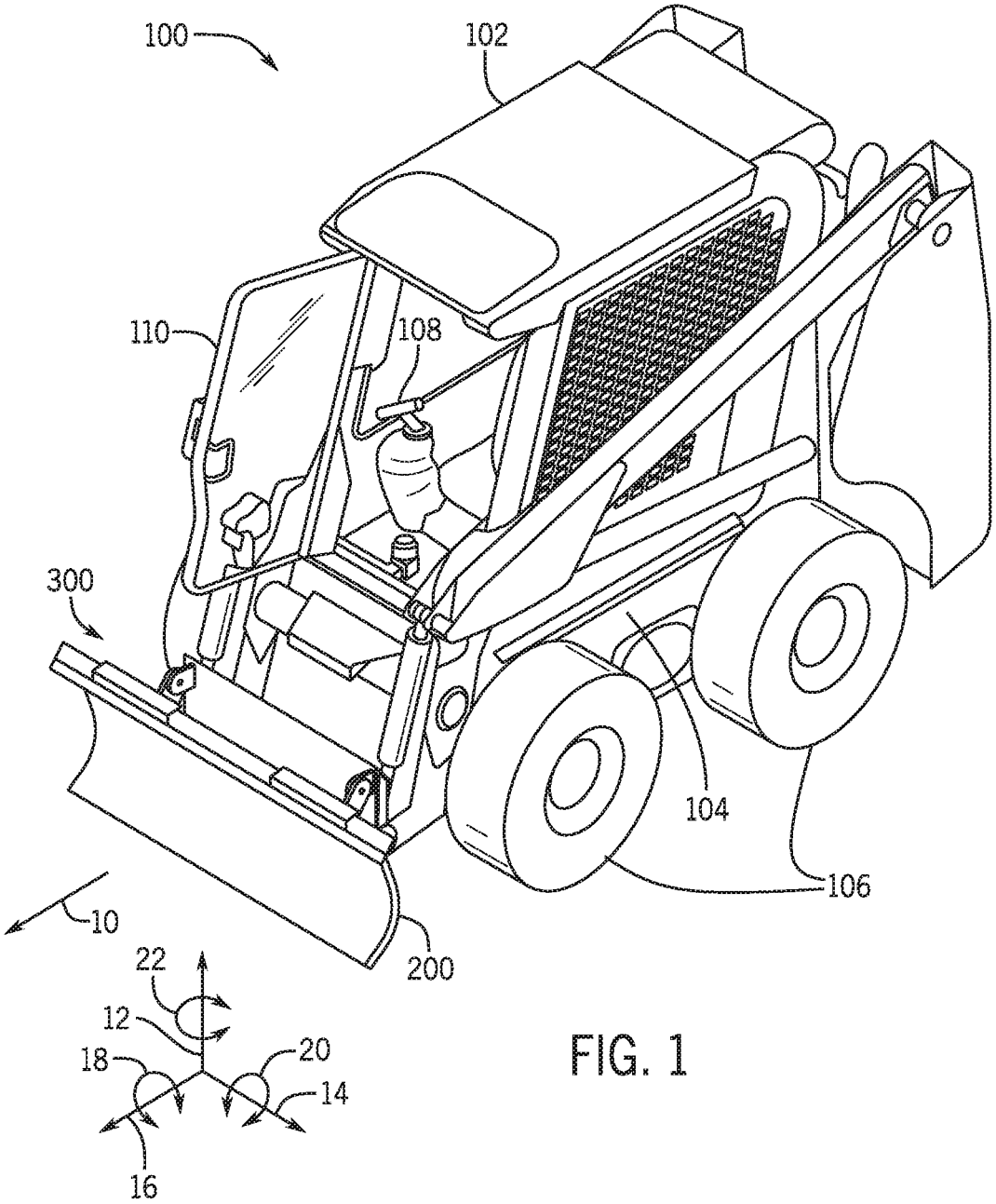
FIG. 1 is a front perspective view of an embodiment of a work vehicle and an embodiment of an attachment system for an implement.

FIG. 1 is a front perspective view of an embodiment of a work vehicle 100 and an embodiment of an attachment system for an implement. In the illustrated embodiment, the work vehicle 100 is a skid steer. However, it should be appreciated that the implement attachment system disclosed herein may be utilized on other work vehicles, such as tractors and dozers, among other work vehicles. In the illustrated embodiment, the work vehicle 100 includes a cab 102 and a chassis 104. In certain embodiments, the chassis 104 is configured to house a motor (e.g., diesel engine, etc.), a hydraulic system (e.g., including a pump, valves, a reservoir, etc.), and other components (e.g., an electrical system, a cooling system, etc.) that facilitate operation of the work vehicle. In addition, the chassis 104 is configured to support the cab 102 and wheels 106. The wheels 106 may be driven to rotate by the motor and/or by component(s) of the hydraulic system (e.g., hydraulic motor(s), etc.). While the illustrated work vehicle 100 includes wheels 106, it should be appreciated that in alternative embodiments, the work vehicle may include tracks or a combination of wheels and tracks.

The cab 102 is configured to house an operator of the work vehicle 100. Accordingly, various controls, such as the illustrated hand controller 108, are positioned within the cab 102 to facilitate operator control of the work vehicle 100. For example, the controls may enable the operator to control the rotational speed of the wheels 106, thereby facilitating adjustment of the speed and/or the direction of the work vehicle 100. In the illustrated embodiment, the cab 102 includes a door 110 to facilitate ingress and egress of the operator from the cab 102.

In the illustrated embodiment, a front implement, such as the illustrated dozer blade 200, is coupled to the work vehicle 100. As illustrated, the dozer blade 200 is positioned forward of the chassis 104 relative to a direction of travel 10. As discussed in detail below, the dozer blade 200 is coupled to the work vehicle 100 by an attachment system 300. In certain embodiments, the attachment system 300 includes an implement attachment assembly and a work vehicle attachment assembly. The attachment assemblies are configured to interact with one another to couple the dozer blade 200 to the work vehicle 100. In certain embodiments, the implement attachment assembly includes a linkage configured to control movement of the dozer blade 200 relative to the work vehicle 100. For example, the linkage may be configured to move the dozer blade 200 along a vertical axis 12, while substantially blocking movement of the dozer blade 200 along a lateral axis 14 and/or along a longitudinal axis 16. In certain embodiments, an actuator assembly may be coupled to the dozer blade 200 and configured to rotate the dozer blade 200 about the longitudinal axis 16 in roll 18, about the lateral axis 14 in pitch 20, about the vertical axis 12 in yaw 22, or a combination thereof. While the front implement is a dozer blade in the illustrated embodiment, it should be appreciated that in alternative embodiments, the front implement may be another suitable type of implement (e.g., a broom, an auger, a grapple, etc.).

Figure 2:
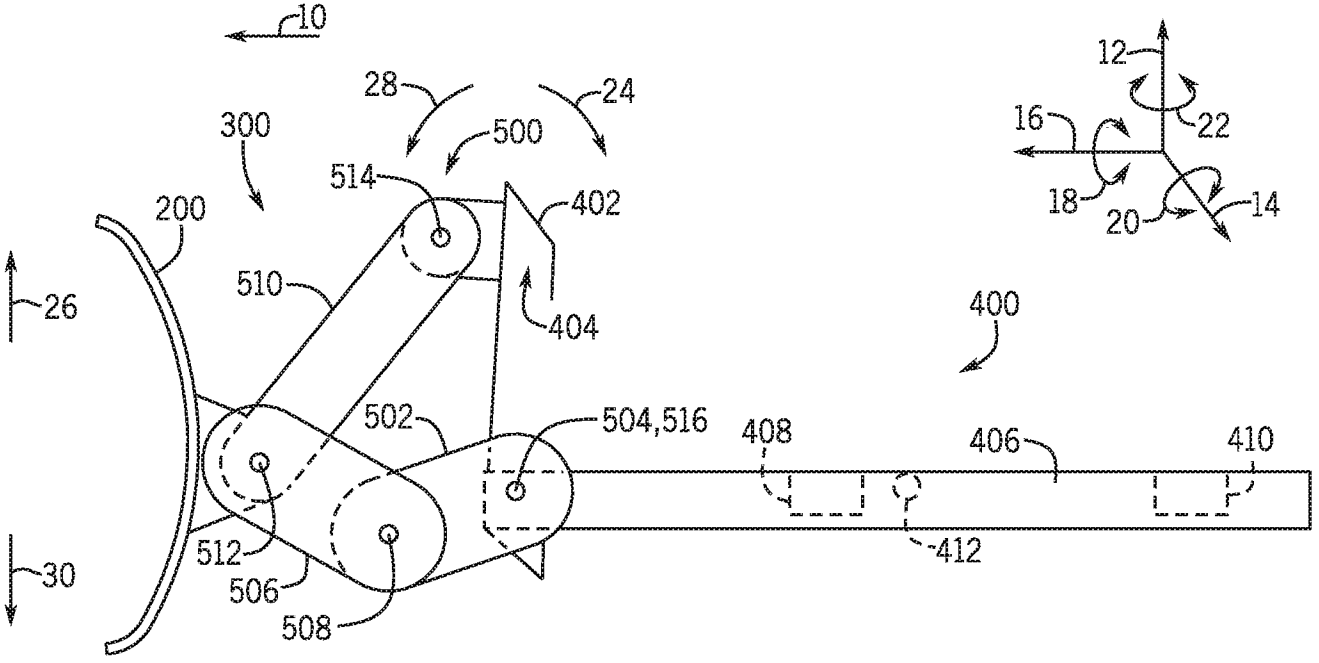
FIG. 2 is a schematic diagram of an embodiment of an implement attachment assembly that may be used within the attachment system of FIG. 1.

FIG. 2 is a schematic diagram of an embodiment of an implement attachment assembly 400 that may be used within the attachment system 300 of FIG. 1. In the illustrated embodiment, the implement attachment assembly 400 includes a receiver assembly 402 configured to couple to a connector assembly of the arm of the work vehicle. In the illustrated embodiment, the receiver assembly 402 has a recess 404 configured to receive a protrusion of the connector assembly. In certain embodiments, the receiver assembly may also include a locking feature configured to secure the receiver assembly 402 to the connector assembly of the work vehicle. For example, the locking feature may include at least one recess configured to receive an extendable pin from a corresponding locking feature of the connector assembly.

In the illustrated embodiment, the implement attachment assembly 400 also includes a support structure 406 pivotally coupled to the receiver assembly 402. The support structure 406 is configured to be positioned beneath a bottom surface of the work vehicle, and the support structure 406 includes mounting features configured to engage corresponding mounting features of the work vehicle while the support structure is positioned beneath the bottom surface of the work vehicle. In the illustrated embodiment, the mounting features include a first recess 408, a second recess 410, and a pin 412. As illustrated, the mounting features are spaced apart from one another along the longitudinal axis 16 relative to the direction of travel 10. Each recess is configured to engage a corresponding pin of the work vehicle attachment assembly. Engagement of each recess with the corresponding pin substantially blocks horizontal movement of the support structure 406 relative to the work vehicle (e.g., substantially blocks movement along the longitudinal axis 16 and along the lateral axis 14). In addition, engagement of the pins and the recesses substantially blocks rotation of the support structure 406 relative to the work vehicle in yaw 22.

In addition, the pin 412 is configured to engage a retractable hook of the work vehicle attachment assembly. Engagement of the pin 412 and the hook substantially blocks downward movement of the support structure 406 relative to the work vehicle along the vertical axis 12. Accordingly, the mounting features of the implement attachment assembly 400 are configured to substantially block horizontal, vertical, and rotational movement of the support structure relative to the work vehicle.

While the illustrated implement attachment assembly includes two recess, it should be appreciated that in alternative embodiments, the implement attachment assembly may include more or fewer recesses. For example, in certain embodiments, the implement attachment assembly may include 1, 2, 3, 4, 5, 6, or more recesses, and the work vehicle attachment assembly may include a corresponding number of pins (e.g., extendable pins). In addition, while the illustrated implement attachment assembly include a single pin, it should be appreciated that in alternative embodiments, the implement attachment assembly may include more pins. For example, in certain embodiments, the implement attachment assembly may include 1, 2, 3, 4, 5, 6, or more pins, and the work vehicle attachment assembly may include a corresponding number of hooks (e.g., retractable hooks). In addition, while the illustrated implement attachment assembly includes the pin and the recesses, it should be appreciated that the pin or at least one recess may be omitted in alternative embodiments. Moreover, the implement attachment assembly may include at least one other mounting feature (e.g., instead of the pin and/or recess(es), or in addition to the pin and/or recess(es)) configured to engage at least one corresponding mounting feature of the work vehicle attachment assembly to substantially block at least one of horizontal, vertical, and rotational movement of the support structure relative to the work vehicle (e.g., one or more latches, one or more fasteners, one or more magnetic couplings, etc.).

In the illustrated embodiment, the support structure 406 includes one substantially flat plate. The weight of the substantially flat plate may lower the center of gravity of the work vehicle/implement system and/or shift the center of gravity forward, thereby enabling the work vehicle to apply a larger horizontal force with the dozer blade. The recesses are formed in the substantially flat plate, and the pin is coupled to the substantially flat plate (e.g., the pin may extend through an opening in the substantially flat plate). However, it should be appreciated that in alternative embodiments, the support structure may include multiple substantially flat plates (e.g., 2, 3, 4, 5, 6, or more) and/or other suitable structure(s) (e.g., tube(s), rod(s), bar(s), etc.) for mounting to the work vehicle attachment assembly via respective mounting features.

In the illustrated embodiment, the implement attachment assembly 400 includes a linkage 500 coupled to the receiver assembly 402 and to the support structure 406. The linkage 500 is configured to move the dozer blade 200 along the vertical axis 12 in response to rotation of the receiver assembly 402 relative to the support structure 406. As discussed in detail below, the work vehicle attachment assembly may include an actuator configured to rotate the connector assembly relative to the arm of the work vehicle. Accordingly, while the connector assembly is coupled to the receiver assembly 402, rotation of the connector assembly drives rotation of the receiver assembly. As such, the linkage 500 enables the actuator to control the vertical position of the dozer blade 200.

In the illustrated embodiment, the linkage 500 includes a first link 502 rotatably coupled to the support structure 406 at a first pivot joint 504, a second link 506 rotatably coupled to the first link 502 at a second pivot joint 508, and a third link 510 rotatably coupled to the second link 506 at a third pivot joint 512 and rotatably coupled to the receiver assembly 402 at a fourth point joint 514. In addition, the third link 510 is non-rotatably (e.g., fixedly) coupled to the dozer blade 200. In the illustrated embodiment, the receiver assembly 402 is rotatably coupled to the support structure 406 at a fifth point joint 516, and the first and fifth pivot joints are substantially coaxial. Rotation of the receiver assembly 402 in a first pitch direction 24 induces the linkage 500 to move the dozer blade 200 in an upward direction 26 along the vertical axis 12 (e.g., without rotating the dozer blade). In addition, rotation of the receiver assembly 402 in a second pitch direction 28 induces the linkage 500 to move the dozer blade 200 in a downward direction 30 along the vertical axis 12 (e.g., without rotating the dozer blade).

Figure 3:
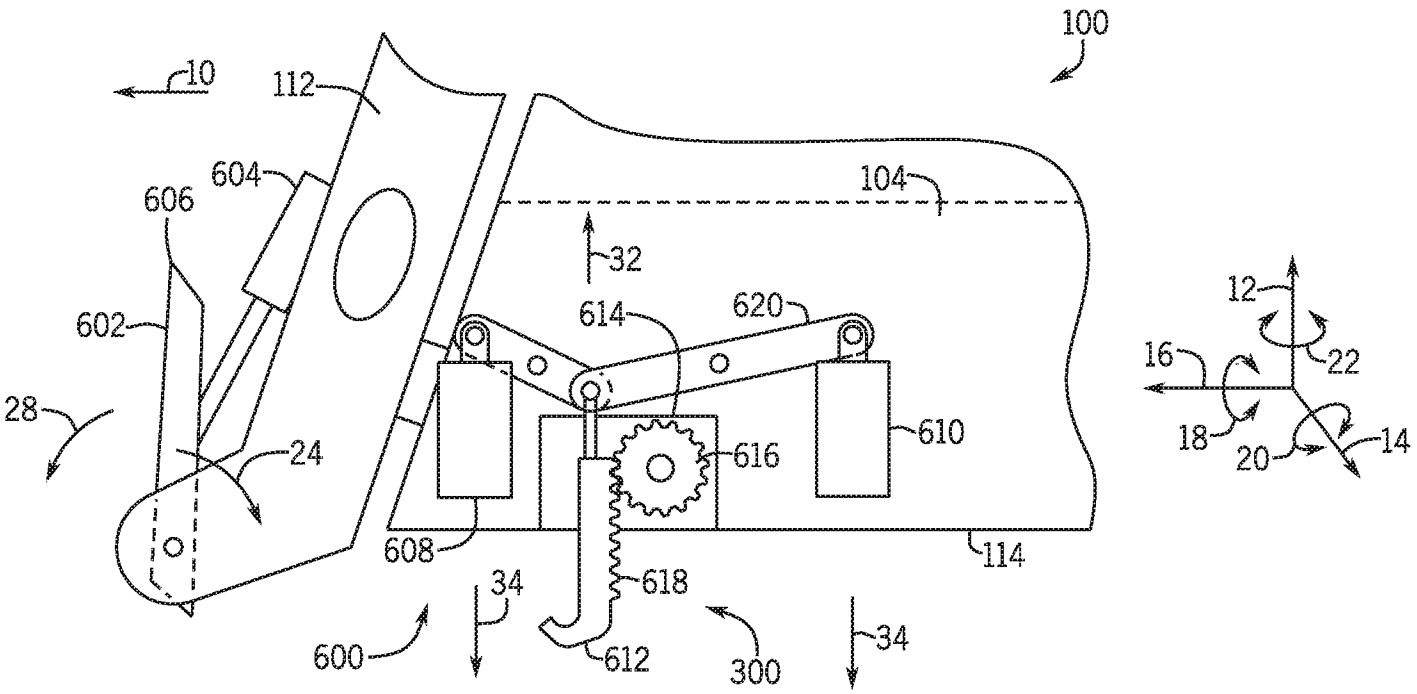
FIG. 3 is a schematic diagram of an embodiment of a work vehicle attachment assembly that may be used within the attachment system of FIG. 1.

FIG. 3 is a schematic diagram of an embodiment of a work vehicle attachment assembly 600 that may be used within the attachment system 300 of FIG. 1. In the illustrated embodiment, the work vehicle attachment assembly 600 includes a connector assembly 602 configured to couple to the receiver assembly of the implement attachment assembly. As illustrated, the connector assembly 602 is pivotally coupled to an arm 112 of the work vehicle 100. In addition, an actuator 604 extends between the arm 112 and the connector assembly 602. In the illustrated embodiment, the actuator 604 is a hydraulic cylinder. However, it should be appreciated that in alternative embodiments, the actuator may be an electromechanical actuator, a pneumatic actuator, or any other suitable type of actuator. The actuator 604 is configured to drive the connector assembly 602 to rotate in pitch 20 (e.g., in the first pitch direction 24 and in the second pitch direction 28), thereby driving the receiver assembly of the implement attachment assembly to rotate. As previously discussed, rotation of the receiver assembly induces the linkage to move the dozer blade along the vertical axis.

In the illustrated embodiment, the connector assembly 602 includes a protrusion 606 configured to engage the corresponding recess within the receiver assembly of the implement attachment assembly. In certain embodiments, the connector assembly may include one or more extendable pins configured to engage corresponding recess(es) or opening(s) in the receiver assembly to secure the connector assembly to the receiver assembly. For example, to couple the connector assembly to the receiver assembly, the protrusion of the connector assembly may be engaged with the recess of the receiver assembly. One or more actuators may then drive the extendable pin(s) of the connector assembly into engagement with the recess(es) or opening(s) in the receiver assembly, thereby securing the connector assembly to the receiver assembly.

In the illustrated embodiment, the work vehicle attachment assembly 600 includes a first pin 608, a second pin 610, and a hook 612. Each pin is configured to engage a corresponding recess within the support structure of the implement attachment assembly. Engagement of each pin with the corresponding recess substantially blocks horizontal movement of the support structure relative to the work vehicle 100 (e.g., substantially blocks movement along the longitudinal axis 16 and along the lateral axis 14). In addition, engagement of the pins and the recesses substantially blocks rotation of the support structure relative to the work vehicle in yaw 22.

In addition, the hook 612 (e.g., retractable hook) is configured to engage a pin of the implement attachment assembly. Engagement of the hook 612 and the pin substantially blocks downward movement of the support structure relative to the work vehicle along the vertical axis 12. Accordingly, the mounting features of the work vehicle attachment assembly 600 are configured to substantially block horizontal, vertical, and rotational movement of the support structure relative to the work vehicle.

While the illustrated work vehicle attachment assembly includes two pins, it should be appreciated that in alternative embodiments, the work vehicle attachment assembly may include more or fewer pins. For example, in certain embodiments, the work vehicle attachment assembly may include 1, 2, 3, 4, 5, 6, or more pins, and the implement attachment assembly may include a corresponding number of recesses. In addition, while the illustrated work vehicle attachment assembly includes a single hook, it should be appreciated that in alternative embodiments, the work vehicle attachment assembly may include more hooks. For example, in certain embodiments, the work vehicle attachment assembly may include 1, 2, 3, 4, 5, 6, or more hooks, and the implement attachment assembly may include a corresponding number of pins. In addition, while the illustrated work vehicle attachment assembly includes the hook and the pins, it should be appreciated that the hook or at least one pin may be omitted in alternative embodiments. Moreover, the work vehicle attachment assembly may include at least one other mounting feature (e.g., instead of the hook and/or pin(s), or in addition to the hook and/or pin(s)) configured to engage at least one corresponding mounting feature of the implement attachment assembly to substantially block at least one of horizontal, vertical, and rotational movement of the support structure relative to the work vehicle (e.g., one or more latches, one or more fasteners, one or more magnetic couplings, etc.).

In the illustrated embodiment, the work vehicle attachment assembly 600 includes an actuator 614 configured to move the hook 612 between a lowered position to engage the pin of the implement attachment assembly and a raised position to couple the support structure to the work vehicle 100. In the illustrated embodiment, the actuator 614 includes a gear 616 configured to engage teeth 618 on the hook 612. Rotation of the gear 616 drives the hook 612 to move along the vertical axis 12 from the illustrated lowered position to the raised position. While the hook 612 is in the illustrated lowered position, the hook 612 may engage the pin of the implement attachment assembly. The actuator 614 is configured to drive the hook 612 in a upward direction 32 along the vertical axis 12, thereby driving the support structure of the implement attachment assembly into contact with a bottom surface 114 of the work vehicle 100. In certain embodiments, the gear 616 may be driven to rotate by an electric motor or a hydraulic motor, among other suitable drive mechanisms. Furthermore, while the hook is driven to move along the vertical axis by a gear/teeth system, it should be appreciated that in alternative embodiments, the hook may be driven to move along the vertical axis by another suitable drive mechanism, such as a hydraulic cylinder, a pneumatic cylinders, or an electromechanical actuator, among others.

In the illustrated embodiment, the work vehicle attachment assembly 600 includes a linkage 620 extending between the hook 612 and the pins 608 and 610. The linkage 620 is configured to move the pins 608 and 610 in a downward direction 34 along the vertical axis 12 from the illustrated retracted position to an extended position in response to movement of the hook 612 in the upward direction 32. While the pins 608 and 610 are in the illustrated retracted position, the work vehicle 100 may move in the direction of travel 10 until the hook 612 engages the pin of the implement attachment assembly. Once the hook is engaged with the implement attachment assembly pin, the actuator 614 may move the hook 612 in the upward direction 32, thereby driving the support structure into contact with the bottom surface 114 of the work vehicle 100 and driving the pins 608 and 610 into engagement with the corresponding recesses in the support structure. While the pins 608 and 610 are engaged with the corresponding recesses, and the hook 612 is engaged with the corresponding pin, horizontal, vertical, and rotational movement of the support structure relative to the work vehicle may be substantially blocked. While the pins 608 and 610 are driven by the linkage 620 in the illustrated embodiment, it should be appreciated that in alternative embodiments, at least one pin may be driven by a separate actuator (e.g., a separate actuator for each pin, one actuator for both pins, etc.), such as a hydraulic cylinder, a pneumatic cylinder, an electromechanical actuator, or any other suitable type of actuator.

Figure 4:
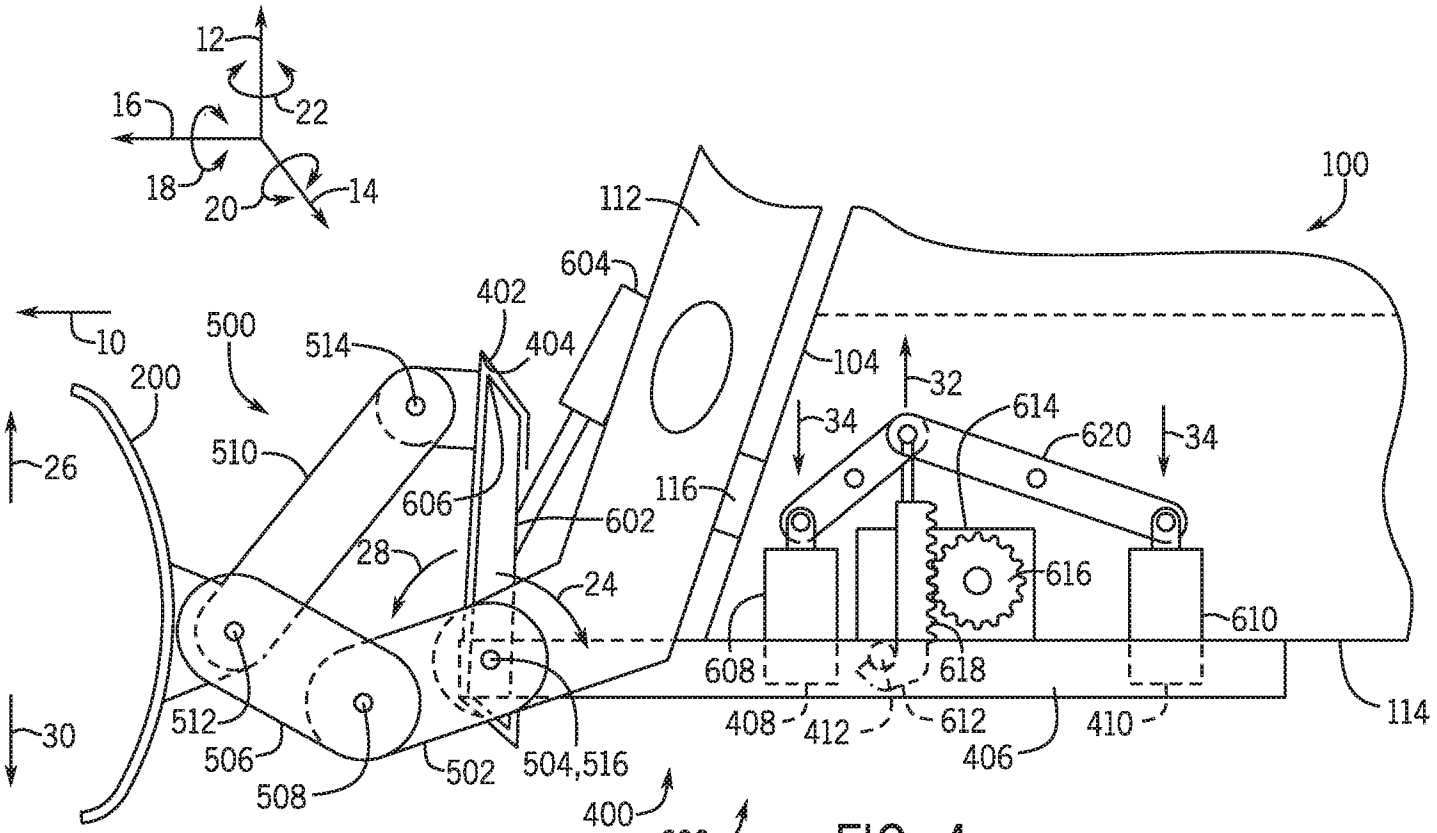
FIG. 4 is a schematic diagram of the implement attachment assembly of FIG. 2 and the work vehicle attachment assembly of FIG. 3 coupled to one another.

FIG. 4 is a schematic diagram of the implement attachment assembly 400 of FIG. 2 and the work vehicle attachment assembly 600 of FIG. 3 coupled to one another. To facilitate coupling the attachment assemblies to one another, the work vehicle 100 may move in the direction of travel 10 toward the dozer blade 200 and the implement attachment assembly 400, which may be positioned on the ground. Before approaching the dozer blade/implement attachment assembly, the hook 612 may be transitioned to the lowered position, and the pins 608 and 610 may be transitioned to the retracted position. When the work vehicle reaches a target position relative to the dozer blade/implement attachment assembly, the protrusion 606 of the connector assembly 602 may be engaged with the recess 404 of the receiver assembly 402 (e.g., via movement of the arm 112, via movement of the work vehicle 100, via rotation of the connector assembly 602, or a combination thereof). Once the protrusion of the connector assembly is engaged with the recess of the receiver assembly, the extendable pin(s) of the connector assembly may engage the recess(es) or opening(s) of the receiver assembly, thereby securing the connector assembly to the receiver assembly.

Positioning the work vehicle in the target position and engaging the connector assembly with the receiver assembly positions the work vehicle such that the hook 612 engages the pin 412, and the pins 608 and 610 are aligned with the recesses 408 and 410. Once aligned, the actuator 614 drives the hook 612 in the upward direction 32, thereby driving the support structure 406 into contact with the bottom surface 114 of the work vehicle 100. In addition, upward movement of the hook 612 induces the linkage 620 to drive the pins 608 and 610 in the downward direction 34, thereby driving the pins 608 and 610 into engagement with the respective recesses 408 and 410. As previously discussed, engagement of the pins 608 and 610 with the respective recesses 408 and 410 substantially blocks horizontal movement of the support structure 406 relative to the work vehicle 100 (e.g., substantially blocks movement along the longitudinal axis 16 and along the lateral axis 14). In addition, engagement of the pins 608 and 610 with the respective recesses 408 and 410 substantially blocks rotation of the support structure 406 relative to the work vehicle 100 in yaw 22. Furthermore, contact between the hook 612 and the pin 412 substantially blocks movement of the support structure 406 in the downward direction 34 along the vertical axis 12, and contact between the support structure 406 and the bottom surface 114 of the work vehicle 100 substantially blocks movement of the support structure 406 in the upward direction 32 along the vertical axis 12. Moreover, contact between the support structure 406 and the bottom surface 114 of the work vehicle 100 substantially blocks rotation of the support structure 406 relative to the work vehicle 100 in pitch 20 and roll 18.

In certain embodiments, the support structure may not contact the bottom surface of the work vehicle while the attachment assemblies are coupled to one another. In such embodiments, contact between bottom surfaces of the work vehicle attachment assembly pins and top surfaces of the respective implement attachment assembly recesses may substantially block movement of the support structure in the upward direction along the vertical axis. In addition, contact between side surfaces of the work vehicle attachment assembly pins and side surfaces of the respective implement attachment assembly recesses may substantially block rotation of the support structure relative to the work vehicle in pitch and roll.

With the attachment assemblies coupled to one another, the weight of the dozer blade/implement attachment assembly is support by the connector assembly 602 and the hook 612. As illustrated, the protrusion 606 of the connector assembly 602 is in contact with the receiver assembly 402. Accordingly, a portion of the weight of the dozer blade/implement attachment assembly is supported by the connector assembly 602 and, in turn, the arm 112 of the work vehicle 100 (e.g., the portion of the weight may be transferred from the arm to the work vehicle chassis via an arm pivot joint). In addition, due to the contact between the hook 612 and the pin 412, the hook 612 also supports a portion of the weight of the dozer blade/implement attachment assembly. The hook 612, in turn, transfers the portion of the weight to the work vehicle chassis 104.

The attachment assemblies are also configured to transfer the horizontal load on the dozer blade to the work vehicle. As illustrated, the dozer blade 200 is coupled to the arm 112 of the work vehicle 100 via the linkage 500, the receiver assembly 402, and the connector assembly 602. Accordingly, a portion of the horizontal load on the dozer blade 200 is transferred to the arm 112 (e.g., the portion of the horizontal load may be transferred from the arm to the work vehicle chassis via an arm pivot joint). In the illustrated embodiment, a spacer 116 is coupled to the chassis 104 of the work vehicle 100. The spacer 116 is configured to transfer the horizontal load, which is applied to the arm 112 by the dozer blade 200, to the chassis 104. In addition, the dozer blade 200 is coupled to the support structure 406 by the linkage 500. Accordingly, a portion of the horizontal load applied to the dozer blade 200 is transferred to the support structure 406. The support structure 406, in turn, transfers the portion of the horizontal load to the work vehicle chassis 104 via the pins 608 and 610. Because a portion of the horizontal load on the dozer blade is transferred to the chassis of the work vehicle via the linkage, the support structure, and the pins, the maximum force rating of the dozer blade may be increased, as compared to a configuration in which the horizontal force is transferred to the arm alone. In addition, because a portion of the horizontal load on the arm is transferred to the chassis via the spacer, the maximum force rating of the dozer blade may be increased, as compared to a configuration in which the spacer is omitted, and the horizontal load is transferred from the arm to the chassis only at an arm pivot joint.

As previously discussed, the actuator 604 may be utilized to control the vertical position of the dozer blade 200. For example, the actuator 604 may rotate the connector assembly 602 in the direction 24, thereby driving the receiver assembly 402 to rotate in the direction 24. Rotation of the receiver assembly 402 in the direction 24 induces the linkage 500 to move the dozer blade 200 in an upward direction 26 along the vertical axis 12. In addition, the actuator 604 may rotate the connector assembly 602 in the direction 28, thereby driving the receiver assembly 402 to rotate in the direction 28. Rotation of the receiver assembly 402 in the direction 28 induces the linkage 500 to move the dozer blade 200 in a downward direction 30 along the vertical axis 12.

While only certain features have been illustrated and described herein, many modifications and changes will occur to those skilled in the art. It is, therefore, to be understood that the appended claims are intended to cover all such modifications and changes as fall within the true spirit of the disclosure.

The invention claimed is:

1. An attachment system for a work vehicle implement, comprising:

an implement attachment assembly, comprising:

a receiver assembly configured to couple to a connector assembly of an arm of a work vehicle;

a linkage coupled to the receiver assembly, wherein the linkage is configured to move the work vehicle implement relative to a vertical axis in response to rotation of the receiver assembly relative to the arm of the work vehicle; and a support structure coupled to the receiver assembly and configured to couple to the work vehicle via at least one mounting feature of the support structure;

wherein the linkage comprises a first link rotatably coupled to the support structure at a first pivot joint, a second link pivotally coupled to the first link at a second pivot joint, and a third link pivotally coupled to the second link at a third pivot joint and pivotally coupled to the receiver assembly at a fourth pivot joint; and wherein the third link is configured to be non-rotatably coupled to the work vehicle implement.

2. The attachment system of claim 1, wherein the receiver assembly is pivotally coupled to the support structure at a fifth pivot joint, and the first and fifth pivot joints are substantially coaxial.

3. The attachment system of claim 1, wherein the at least one mounting feature of the support structure comprises a first mounting feature configured to engage a first corresponding mounting feature extending downwardly from a bottom surface of the work vehicle, and a second mounting feature configured to engage a second corresponding mounting feature extending downwardly from the bottom surface of the work vehicle.

4. The attachment system of claim 3, wherein the first mounting feature of the support structure comprises a recess, the first corresponding mounting feature comprises a pin configured to engage the recess, and the recess is configured to substantially block horizontal movement of the support structure relative to the work vehicle via engagement with the pin.

5. The attachment system of claim 3, wherein the second mounting feature of the support structure comprises a pin, the second corresponding mounting feature comprises a hook, and the pin is configured to substantially block vertical movement of the support structure relative to the work vehicle via engagement with the hook.

6. The attachment system of claim 3, wherein the support structure comprises a substantially flat plate.

7. The attachment system of claim 6, wherein the first mounting feature of the support structure comprises a recess formed in the substantially flat plate.

8. An attachment system for a work vehicle implement, comprising:

an implement attachment assembly, comprising:

a receiver assembly configured to couple to a connector assembly of an arm of a work vehicle;

a support structure coupled to the receiver assembly, wherein the support structure comprises a first mounting feature configured to engage a first corresponding mounting feature extending downwardly from a bottom surface of the work vehicle, and a second mounting feature configured to engage a second corresponding mounting feature extending downwardly from the bottom surface of the work vehicle; and a linkage coupled to the receiver assembly, wherein the linkage is configured to move the work vehicle implement relative to a vertical axis in response to rotation of the receiver assembly relative to the arm of the work vehicle;

wherein the first and second mounting features of the support structure are configured to substantially block horizontal and vertical movement of the support structure relative to the work vehicle via engagement with the first and second corresponding mounting features of the work vehicle.

9. The attachment system of claim 8, wherein the linkage comprises a first link rotatably coupled to the support structure at a first pivot joint, a second link pivotally coupled to the first link at a second pivot joint, and a third link pivotally coupled to the second link at a third pivot joint and pivotally coupled to the receiver assembly at a fourth pivot joint; and wherein the third link is configured to be non-rotatably coupled to the work vehicle implement.

10. The attachment system of claim 9, wherein the receiver assembly is pivotally coupled to the support structure at a fifth pivot joint, and the first and fifth pivot joints are substantially coaxial.

11. The attachment system of claim 8, wherein the first mounting feature of the support structure comprises a recess, the first corresponding mounting feature comprises a pin configured to engage the recess, and the recess is configured to substantially block horizontal movement of the support structure relative to the work vehicle via engagement with the pin.

12. The attachment system of claim 8, wherein the second mounting feature of the support structure comprises a pin, the second corresponding mounting feature comprises a hook, and the pin is configured to substantially block vertical movement of the support structure relative to the work vehicle via engagement with the hook.

13. The attachment system of claim 8, wherein the support structure comprises a substantially flat plate.

14. The attachment system of claim 13, wherein the first mounting feature of the support structure comprises a recess formed in the substantially flat plate.

15. An attachment system for a work vehicle implement, comprising:

a work vehicle attachment assembly, comprising:

a connector assembly pivotally coupled to an arm of a work vehicle;

a first mounting feature configured to extend downwardly from a bottom surface of the work vehicle;

a second mounting feature configured to extend downwardly from the bottom surface of the work vehicle;

an implement attachment assembly, comprising:

a receiver assembly configured to couple to the connector assembly of the work vehicle attachment assembly; and a support structure coupled to the receiver assembly and comprising a first corresponding mounting feature and a second corresponding mounting feature, wherein the first and second mounting features of the work vehicle attachment assembly are configured to move relative to a vertical axis of the work vehicle to selectively engage the first and second corresponding mounting features of the support structure of the implement attachment assembly, respectively, to substantially block horizontal and vertical movement of the support structure relative to the work vehicle.

16. The attachment system of claim 15, wherein the implement attachment assembly comprises a linkage coupled to the receiver assembly, and the linkage is configured to move the work vehicle implement relative to the vertical axis in response to rotation of the receiver assembly relative to the arm of the work vehicle.

17. The attachment system of claim 15, wherein the first mounting feature of the work vehicle attachment assembly comprises a pin, the first corresponding mounting feature of the support structure of the implement attachment assembly comprises a recess within the support structure, and the pin is configured to engage the recess to substantially block horizontal movement of the support structure relative to the work vehicle.

18. The attachment system of claim 15, wherein the second mounting feature of the work vehicle attachment assembly comprises a hook, the second corresponding mounting feature of the support structure of the implement attachment assembly comprises a pin, and the hook is configured to engage the pin to substantially block vertical movement of the support structure relative to the work vehicle.

* * * * *